United States Patent [19]

Bolanos

[11] 4,370,973

[45] Feb. 1, 1983

[54] SPACE HEATING STOVE WITH STRESS RELIEVING WALLS

[76] Inventor: Anthony R. Bolanos, 2725 E. Dorchester Pl., Charlotte, N.C. 28209

[21] Appl. No.: 154,828

[22] Filed: May 30, 1980

[51] Int. Cl.[3] ..... F24C 1/00

[52] U.S. Cl. ..... 126/58; 126/190

[58] Field of Search ..... 126/58, 63, 61, 67, 126/65, 66, 190

[56] References Cited

U.S. PATENT DOCUMENTS

| | | | |
|---|---|---|---|
| 51,424 | 12/1865 | Chilson | 126/58 |
| 1,734,843 | 11/1929 | Williams | 126/58 |
| 3,362,394 | 1/1968 | Cole et al. | 126/63 |
| 4,092,976 | 6/1978 | Buckner | 126/63 |

*Primary Examiner*—Daniel J. O'Connor

*Attorney, Agent, or Firm*—Daniel E. McConnell

[57] ABSTRACT

A space heating stove of the solid fuel burning type has a combustion chamber formed of wall means including a wall or walls each formed of sheet metal and being of an irregular nonplanar configuration only in a medial portion thereof for defining a concavo-convex area therein capable of expansion and contraction under heating and cooling conditions thereof to aid in controlling distortion of such wall or walls of the combustion chamber.

1 Claim, 5 Drawing Figures

SPACE HEATING STOVE WITH STRESS RELIEVING WALLS

FIELD AND BACKGROUND OF THE INVENTION

Space heating stoves of a solid fuel burning type, and more particularly wood burning stoves, have come to be of greater importance in recent years as alternative sources for heat have been explored. In particular, recent technological advances have been applied to the fabrication of such stoves using steel plate and similar sheet metal components. Typically, such components are held in place and welded together to form a fabricated stove.

Such fabricated stoves have been found to present difficulties, over extended periods and under certain circumstances of use, in that welded and/or air seal joints have opened up. Distortion of the plate members of a stove, with resultant opening of air seal joints such as between doors and between a stove and chimney or cracking of welds, reduces the efficiency of the stove and may create a fire or smoke hazard. Loss of weld integrity may result from misuse of a stove, where the stove is brought to improperly high temperatures, or may upon occasion result from fatigue due to repeated expansion and contraction of the wall components of the stove.

SUMMARY OF THE INVENTION

It is an object of this invention to overcome the deleterious effects of expansion and contraction on a space heating stove of the type described. In realizing this object of the present invention, provision is made for accommodating expansion and contraction of sheet metal walls of the stove while avoiding stressing of welds used in fabricating the stove.

Yet a further object of the present invention is to maintain substantial dimensional integrity for a stove of the type described by accommodating expansion and contraction of walls of the stove undergoing heating and cooling through the provision of especially confugured areas in the walls. In realizing this object of the present invention, portions of the walls of the stove are given irregular non-planar cross-sectional configurations in medial portions thereof and defining respective concavo-convex areas. Preferably, such areas are defined by a plurality of elongate, generally parallel striations, with at least one of the striations being concave when viewed from one side of the wall and with at least one other of the striations being convex when being viewed from the same side of the wall so as to provide a sinusoidal cross-sectional configuration.

BRIEF DESCRIPTION OF THE DRAWINGS

Some of the objects and advantages of the invention having been stated, others will appear as the description proceeds when taken in connection with the accompanying drawings, in which.

DETAILED DESCRIPTION

Figure 1:
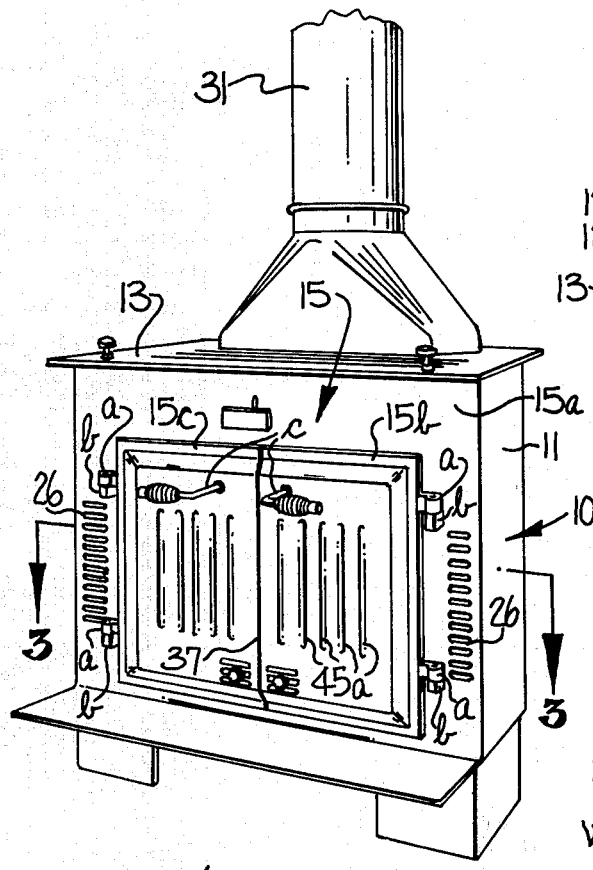
FIG. 1 is a perspective view looking at the top, front and right sides of a stove embodying the present invention.

Referring more specifically to the drawings, the stove embodying the present invention generally comprises a housing broadly designated at 10 which is of generally rectangular box-like form and includes wall means comprising opposite exterior or outer side walls 11, 12, a top wall 13, a bottom wall 14, a front wall 15, and an outer rear wall 16, all of which are made of sheet metal. The stove also includes sheet metal wall means, cooperating with the top wall 13 and the front wall 15 for defining therewith a combustion chamber or firebox generally designated at 20. The sheet metal used preferably is steel plate of substantially uniform thickness and being on the order of about one quarter inch thick. Accordingly, in addition to the top wall 13 and the front wall 15, the combustion chamber wall means includes opposite side walls 11', 12', a bottom wall 14', and a rear wall 16'. As shown, the opposite side walls 11', 12', the rear wall 16', and the bottom wall 14' of combustion chamber 20 are spaced inwardly from the respective side walls 11, 12, the rear wall 16, and the bottom wall 14 of the housing 10 for defining a heating chamber 21 between the housing outer walls 11, 12, 14, 16 and the respective inner or combustion chamber walls 11', 12', 14', 16'.

The lower central portion of the outer rear wall 16 of housing 10 is provided with a suitable opening 25 therethrough adapted to accommodate an air blowing fan, not shown, positioned proximal to the inner rear wall 16' for discharging heated air from the heating chamber 21 outwardly through openings 26 provided in opposite side portions of the front wall 15. The rear portion of the top wall 13 is also provided with a suitable smoke escapement opening 30 therethrough for being communicatively connected to a suitable smoke discharge pipe or chimney 31, as shown in FIG. 1.

The stove is provided with a relatively large access opening 35 (FIGS. 3 and 5) in its front wall 15 for inserting combustibles, i.e., solid fuel, such as wood, coal, and the like, therethrough into the combustion chamber 20. In this instance, the front wall 15 comprises a substantially vertical panel **15*a* formed of sheet metal and having the access opening 35 therethrough. The front wall 15 further comprises door means, in the form of a pair of metal doors 15*b*, 15*c* normally overlying and closing the access opening 35 and being provided with proximal normally abutting substantially vertical side edges 37 thereof. Further, hinge means are provided for pivotally connecting the distal side edge portions of the doors 15*b*, 15*c* to the panel 15*a* of front wall 15 adjacent opposite sides of the opening 35. To this end, it will be observed in FIG. 1 that the distal side edge portions of the access doors 15*b*, 15*c* have outwardly projecting portions a thereon which are pivotally and supportingly mounted upon respective hinge elements b welded to the panel 15*a* of front wall 15. The doors 15*b*, 15*c* are provided with suitable handle means, embodied in respective handles c, for manually opening and closing the doors. Conventional latch means, not shown, may be provided in association with one or the other or both of the handles c for holding the doors 15*b*, 15*c*** in the normally closed position.

The structure thus far described is representative of a typical wood-burning stove fabricated of sheet metal walls welded together by filet welds or bead welds extending along the junctures of adjacent walls. In the illustrated embodiment of the typical stove, although the opposite substantially vertical side edges of the outer and inner rear walls 16, 16' may be welded to the rear edges of the respective pairs of opposite side walls 11, 12 and 11', 12', the outer walls 11, 12, 16 are shown, as preferred, as being of one-piece construction, and the inner walls 11', 12', 16' also are shown, as preferred, as being of one-piece construction. In other words, in each instance, the opposite side walls and the rear wall comprise a common sheet metal element generally U-shaped in plan. However, it will be observed in FIG. 3 that the substantially vertical front edges of the opposite outer side walls 11, 12 and the opposite inner side walls 11', 12' are welded along the lengths thereof, by respective welds W-1, W-2, W-1' and W-2' to the panel 15*a* of the housing front wall 15.

Figure 5:
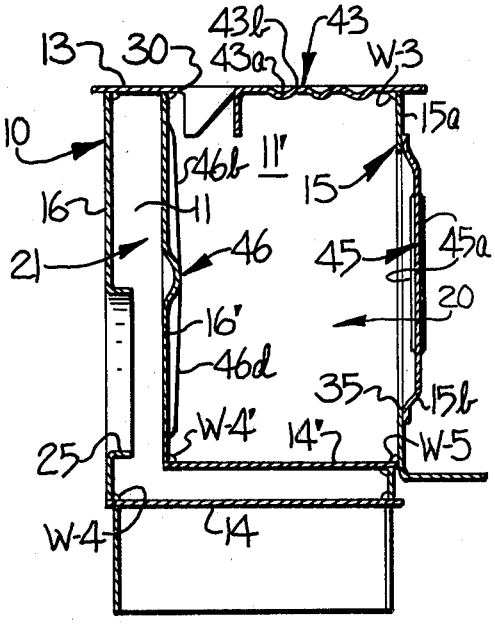
FIG. 5 is a vertical sectional view taken substantially along line 5—5 in FIG. 3.

Similarly , the upper edge portions of the walls 11, 12, 16, 11', 12', 16' and panel 15*a* of front wall 15 are secured to the upper or top wall 13 of housing 10 by welds W-3, and the lower edge portions of the walls 11, 12, 16 are secured by respective welds W-4, to the outer bottom wall 14. The lower edge portions of the walls 11', 12', 16' are secured to the inner or upper bottom wall 14' by welds W-4' and the front edge portion of the inner bottom wall 14' is welded to the lower portion of the substantially vertical panel 15*a* of front wall 15 by a weld W-5 (FIG. 5).

Although the proximal portions of other metal components of the stove may be secured together by welding as needed, a further description of the stove as typically constructed is deemed unnecessary, since the present invention is essentially concerned with only those welds of the stove or other components thereof which are susceptible to damage by high temperatures and substantial temperature variations produced by combustion of fuel in the combustion chamber 20. In this regard, in stoves of the prior art, such high temperatures and variations in temperature have caused substantial and repeated expansion and contraction of the combustion chamber wall means, such as the walls 11', 12', 13', 16' and the front wall 15 which has resulted in buckling of such walls and/or separation of the respective wall components joined by one or more of the welds, such as the welds W-1', W-2' (FIG. 3), W-3, W-4' and/or W-5. Buckling of the walls has on occasion led to air and/or smoke leakage which interferes with stove operation.

To overcome the above and other problems attendant to the expansion and contraction of the combustion chamber walls means in accordance with this invention, at least one or each of certain of the combustion chamber walls is of irregular nonplanar configuraton in a medial portion only thereof for defining a concavo-convex area therein capable of expansion and contraction under heating and cooling cnditions of the corresponding wall virtually without changing the overall dimensions of the wall. Thus, such concavo-convex areas localize the expansion and contraction in medial portions of the respective wall to prevent undesirable distortions or buckling of the wall and thereby aid in preventing separation of the wall from others of the walls where they are welded together and also aid in retaining integrity of the welds.

In the illustrated embodiment of the invention, it will be observed that the housing top wall 13 and the housing front wall 15 (which serve as the respective top and front walls of the combustion chamber 20) and the inner rear wall 16' (defining the rear extremity of the combustion chamber 20) are each of irregular nonplanar configuration in a medial portion only thereof defining respective restricted concavo-convex areas broadly designated at 43, 45, 46 therein. Generally, each concavo-convex area 43, 45, 46 is inthe form of elongate striations having opposite ends terminating adjacent but in spaced relation to corresponding opposite edges of the respective wall.

Figure 2:
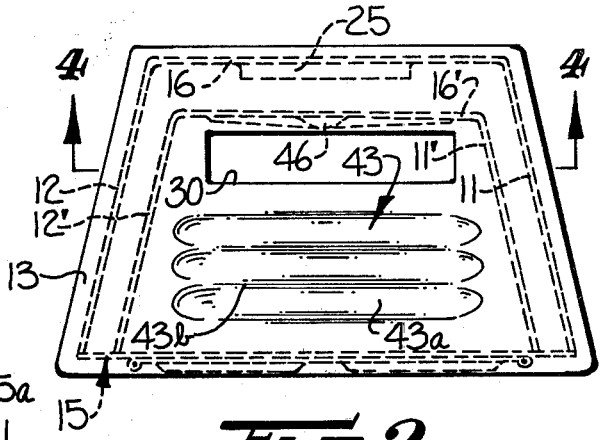
FIG. 2 is an enlarged plan view of the stove shown in FIG. 1, but omitting the smokestack or chimney thereof.

In FIGS. 2 and 5 it will be observed that the concavo-convex area 43 of the top wall 13 is defined by a plurality of elongate substantially parallel striations which are collectively of generally sinusoidal cross-sectional configuration. Thus, at least one of the striations of the concavo-convex area 43 is concave when viewed from one side of the top wall 13, and at least one other of the striations is convex when viewed from the same side of the wall 43. More specifically, the concavo-convex area 43 is shown as comprising three parallel concave striations 43*a* as viewed looking downwardly upon the top wall 13, with two convex striations 43*b* being present extending between opposite sides of the middle concave striation and the two outer concave striations.

Figure 3:
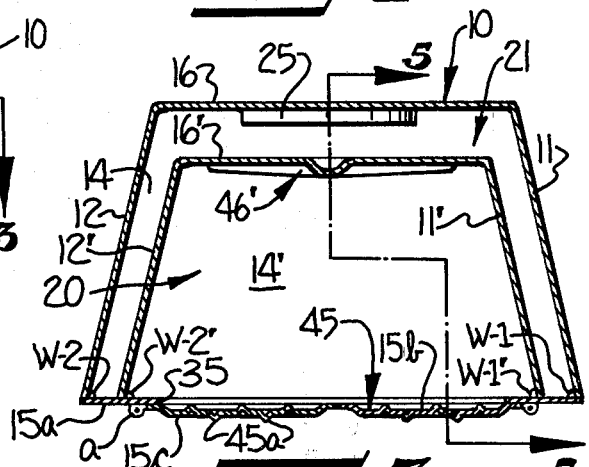
FIG. 3 is an enlarged sectional plan view through the stove taken substantially along line 3—3 in FIG. 1.

Referring now to the concavo-convex area 45 in the front wall 15, it will be observed in FIGS. 1, 3 and 5 that the concavo-convex area 45 takes the form of a plurality of substantially vertically extending elongate striations 45*a* formed in the doors 15*b*, 15*c* which are parts of the front wall 15. The striations 45*a* are spaced apart from each other so that there is a generally flat surface portion of the corresponding door between each adjacent pair of the striations 45*a*, with alternate striations 45*a* being convex when viewed from the exterior our outer side of the doors 15*b*, 15*c* and intervening striations 45*a* being convex when viewed from the exterior or outer side of the doors 15*b*, 15*c*.

By providing the concavo-convex striations 45*a* in the doors 15*b*, 15*c* (whose proximal edges are in abutting relationship at 37 when the doors occupy the closed position), the expansion and contraction of the metal in the doors is generally localized in the concavo-convex area 45 so as to prevent any material distortion in the adjoining edges of the doors, thus avoiding loss of sealing such as might otherwise admit air in an uncontrolled manner.

Figure 4:
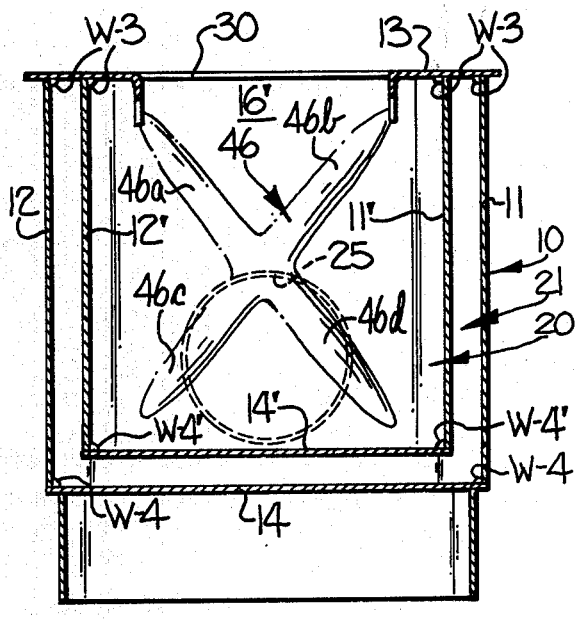
FIG. 4 is a transverse vertical sectional view taken substantially along line 4—4 in FIG. 2.

Referring now to the inner rear wall 16', it will be observed in FIG. 4 that the concavo-convex area 46 conveniently is of generally X-shaped form indicative of various shapes in which such areas may be formed in accordance with the particular function to be served thereby. The X-shaped concavo-convex area 46 includes concavo-convex arm portions 46*a*, 46*b*, 46*c*, 46*d* which terminate inwardly of but adjacent the opposite side edges of the inner rear wall 16' at their junctures with the opposite inner side walls 11', 12'. Since the impeller of the fan, not shown, which is adapted to be positioned in the opening 25 may be positioned relatively cose to the rear surface of the inner rear wall 16', it is preferred that arm portions 46*a*, 46*d* of the concavo-convex area 46 do not project rearwardly of the mean plane of the rear surface of the inner rear wall 16'. Therefore, it will be observed in FIG. 3 and 5 that the arm portions 46*a*–46*d* are so formed that their convex surfaces protrude forwardly from the mean plane of the front surface of the inner rear wall 16'. Due to such forward protrusion, any movement of the wall upon thermal expansion is forwardly away from the fan and toward the firebox. Additionally, it will be noted that a substantial planar area is provided between the lower arm portions 46c, 46d of the concavo-convex area 46 opposite the opening 25 in the outer rear wall 16 to aid in minimizing undesirable turbulence and eddy currents in the airstream as it flows from the impeller of the fan, not shown, adapted to be positioned in the opening 25.

As heretofore indicated, even though the opposite side edge portions of the inner rear wall 16' are shown herein as being formed integral with the inner opposite side walls 11', 12' as opposed to being welded thereto, the concavo-convex area 46 formed in the inner rear wall 16' nevertheless has the important function of generally localizing the expansion and contraction of the inner rear wall under heating and cooling conditions to avoid distorting, warping, and/or buckling the generally planar portions of the inner rear wall 16' between the various arms 46a–46d of the concavo-convex area 46 and thus aid in ensuring an efficient flow of the air through the heating chamber 21 while the aforementioned fan is operating properly as well as aiding in preventing the separation of the upper and lower edges of the combustion chamber walls 11', 12', 16' from the respective upper and lower walls 13 and 14' at the welds W-3 and W-4'.

It is thus seen, that by providing concavo-convex areas in certain of the metal walls defining the combustion chamber of a space-heating, wood-burning stove in accordance with the present invention, the buckling of such walls by expansion and contraction under heating and cooling conditions of the combustion chamber walls is virtually eliminated and the rupture of the welds securing adjacent walls together also is virtually eliminated.

In the drawings and specification, there has been set forth a preferred embodiment of the invention, and although specific terms are employed, they are used in a generic and descriptive sense only and not for purposes of limitation, the scope of the invention being defined in the claims.

That which is claimed is:

1. A space heating, wood burning stove comprising:

a plurality of wall means, defining a combustion chamber, each formed of steel plate having a substantially uniform thickness, and including a front wall comprising a substantially vertical panel having an access opening therethrough for insertion into said combustion chamber, a pair of doors normally closing said access opening and being provided with proximal normally abutting substantially vertical side edges thereon, said panel and said doors being of substantially the same thickness, and hinge means pivotally connecting distal side edge portions of said doors to said panel and including hinge elements pivotally supporting said doors, welded joints securing said hinge elements to said panel, and means for controlling distortion in said doors and for protecting said welded joints against excessive stress and comprising a concavo-convex area forming a limited portion of the area of said one wall and defined by a plurality of elongate, generally parallel striations, with at least one of the striations being concave when viewed from one side of said one wall and with at least one other of said striations being convex when viewed from the same side of said one wall, said concavo-convex area being of generally sinusoidal cross-sectional configuration.

* * * * *